United States Patent [19]

Bizzarri

[11] 4,076,610

[45] Feb. 28, 1978

[54] CATHODE IN CELLS FOR PRODUCING ALUMINIUM BY ELECTROLYSIS OF SMELTED SALTS THEREOF

[75] Inventor: Cesare Bizzarri, Terni, Italy

[73] Assignee: Elettrocarbonium S.p.A., Milan, Italy

[21] Appl. No.: 594,703

[22] Filed: Jul. 10, 1975

[30] Foreign Application Priority Data

Jul. 17, 1974 Italy .....25258/74

[51] Int. Cl.[2] ..... C25C 3/06; C25C 7/02

[52] U.S. Cl. ..... 204/290 R; 204/67; 204/243 R; 204/294

[58] Field of Search ..... 204/67, 243 R, 294, 204/290 R, 286

[56] References Cited

U.S. PATENT DOCUMENTS

| | | | |
|---|---|---|---|
| 2,728,109 | 12/1955 | Bonnot | 264/29 |
| 2,874,103 | 2/1959 | Syz et al. | 204/67 |
| 3,236,753 | 2/1966 | Skantze et al. | 204/67 |
| 3,723,286 | 3/1973 | Hunt et al. | 204/243 R |
| 3,738,918 | 6/1973 | Johnson | 204/290 R |
| 3,764,509 | 10/1973 | Etzel et al. | 204/243 R |
| 3,839,167 | 10/1974 | Sleppy | 204/67 |

*Primary Examiner*—F.C. Edmundson
*Attorney, Agent, or Firm*—Haseltine, Lake & Waters

[57] ABSTRACT

Cathode in cells for producing aluminum by electrolysis of smelted salts thereof. The cathode comprises a block of carbon, graphite or semi-graphite, in which a current bus-bar is at least partially embedded, the bus-bar remaining fast with the block during firing or baking of the latter. The bus-bar is held rigidly fast with the block only by the action of the material comprising said block.

7 Claims, 8 Drawing Figures

CATHODE IN CELLS FOR PRODUCING ALUMINIUM BY ELECTROLYSIS OF SMELTED SALTS THEREOF

The invention relates to a novel cathode in cells for producing aluminum by electrolysis of smelted salts thereof, the cathode comprising carbon, graphite or semi-graphite.

In aluminum production by electrolysis of smelted salts thereof, it is well known to use electrolytic cells, the hearth or working area of which is formed of blocks of prefired carbonaceous material comprising the cathode. Such cathode blocks are interconnected during cell assembling by means of the so-called "carbonaceous paste of crude rammed or monolithic lining." In many circumstances, the cathode hearth or laboratory is laterally defined by the so-called "side plates," also comprising prefired carbonaceous material. The connection between the side plates and cathode blocks is accomplished by filling up the space between the two parts with paste of crude rammed or monolithic lining as applied during cell assembling. On the underside, the cathode blocks are slotted or channelled to accomodate the metal current bus-bar which is secured in the block prior to cell assembling by melted iron casting (iron casting), or by carbonaceous paste of rammed or monolithic lining. The operation of securing the bus-bar with cast iron is carried out as follows. Prior to assembling in the cell, the cathode blocks are turned over and aligned, the current bus-bar having a cross-section less than that of the channel is slipped into said channel and in the empty space left between the bus-bar and channel liquid cast iron is poured.

Such a constructive approach suffers from many disadvantages. Thus, it is apparent that the provision is required for a cupola and remaining equipment for cast iron melting and casting and necessary labor for operation. Moreover, cast iron pouring should be effected with greatest care in order not to produce cracks and flaws which may cause the life of the cell to be lower than normal. It is also required to mechanically remove most of the solid cast iron spits and spots which have solidified outwardly of the channel. Additionally, with the above described fastening system, there is but a negligible operating voltage drop due to faulty electrical contact between said bus-bar and carbonaceous material.

Then, owing to inherent difficulties in the fastening process, the metal bars are generally of a square or rectangular cross-section, and cross-sections of a more convenient shape for reducing the contact resistance between the bar and cathode body cannot be adopted.

As to the final cell structure, while the cathode blocks and side plates are prefired and have followed a clearly defined firing cycle in the factory where they have been produced and have undergone accurate controls, the rammed or monolithic lining paste as applied when assembling will be fired rather quickly and approximately during cell heating and starting step. Therefore, there is a substantial difference between the physical and mechanical characteristics of prefired blocks and those of parts of rammed or monolithic lining paste.

A particular weak point or location in the entire conventional cathode hearth or working area is the joint between said cathode block and rammed or monolithic lining paste at the sides, where the high shrinkage during paste firing causes a tendency for the two parts to separate, or an actual separation, or in any case the building up of cracks in the paste mass. This may result in the liquid bath seeping below the cathode blocks with a resulting etching of current bus-bars from aluminum. Under waste circumstances, said bars would be dissolved. This is followed by bar cross-section reduction until complete interruption thereof. When the number of interrupted bars becomes excessive, the cell is put out of use. Therefore, the need arose of overcoming, or at least restricting said disadvantages, and this is exactly the object of the present invention.

More particularly, it is an object of the present invention to provide cathodes in cells for producing aluminum by electrolysis of smelted salts thereof, which cathodes can be readily made, avoiding the fastening or securing of the current bus-bars by castings of cast iron cast.

Another object of the invention is to provide cathodes wherein the electrical contact resistance between current bus-bars and carbonaceous material of the blocks incorporating said bus-bars is minimized.

A still further object of the invention is to provide cathodes, in which the current bus-bars are protected against attack of the bath of smelted aluminum salts and in which the separation phenomena between cathode blocks and side plates of the hearths or working areas in electrolytic cells can be removed or avoided.

These and still other objects are accomplished by cathodes comprising cathode blocks formed of a carbonaceous material selected from the group comprising carbon, graphite and semi-graphite, each of which accomodating at least one metal current bus-bar, the cathodes being characterized in that said metal bus-bar directly contacts the carbonaceous material comprising each block, said carbonaceous material at least partly surrounding, clamping and firmly holding the bus-bar to form a rigid body therewith.

For a clearer understanding of the structure and features of a cathode according to the present invention, some unrestrictive embodiments thereof will now be described, as compared with a cathode obtained in accordance with the prior art, reference being had to the accompanying drawings, in which.

Figure 1:
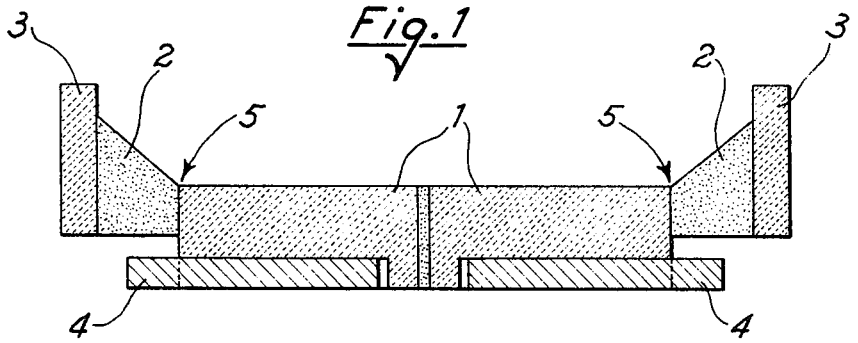
FIG. 1 is a diagrammatic sectional view showing a conventional hearth or laboratory for a cathode in electrolysis cells.
Figure 2:
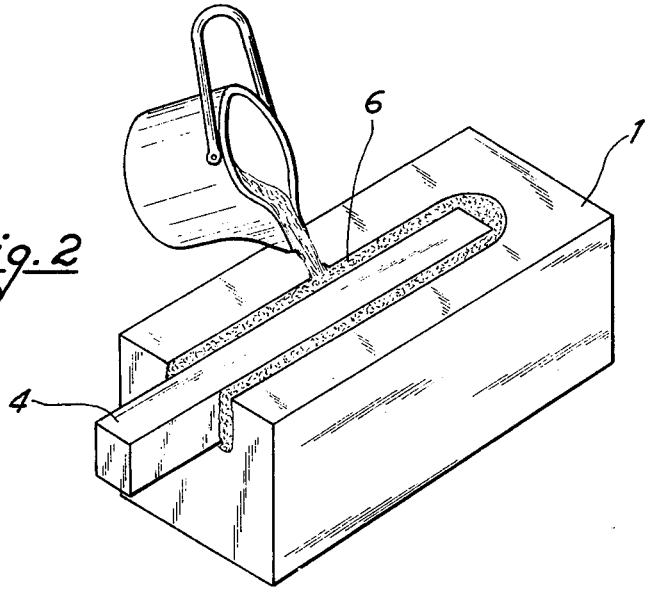
FIG. 2 is a schematic illustration of a conventional cathode which is shown at the step of securing a current bus-bar to a block of carbonaceous material.

Referring first to FIG. 1, in this figure there is shown a schematic sectional view of a conventional cathode hearth or working area for electrolysis cells. Said hearth or laboratory comprises cathode blocks 1 which are connected through rammed or monolithic lining paste 2 to side plates 3. Metal current bus-bars 4 are secured to the underside of said blocks by means of cast iron castings 6 (this operation being shown in FIG. 2). Reference numeral 5 designates the zone where the highest firing shrinkage for said rammed or monolithic lining paste 2 occurs, which is during cell heating and starting, and hence the zone of possible seepages of the electrolytic bath below cathode 4.

Figure 3:
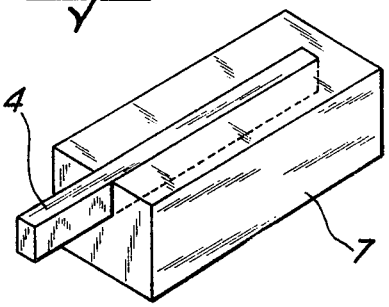
FIGS. 3, 4 and 5 and 7 are perspective views of different cathodes according to the invention.

Reference should now be made to FIG. 3 showing, as a typical exemplary embodiment of the present invention, a cathode block 7 (as made of carbon, graphite or semi-graphite) containing a current bus-bar 4 previously inserted from the molding step, and firmly connected to the carbonaceous material without any interposition of cast iron, rammed or monolithic lining paste or the like.

Figure 4:
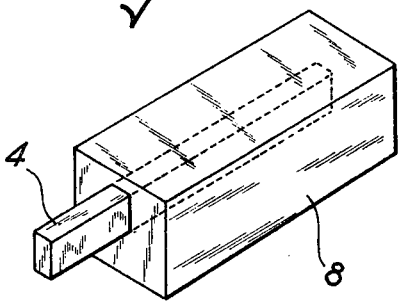

FIG. 4 shows a further exemplary embodiment of a cathode according to the present invention, the cathode comprising a cathode block 8 also containing a current bus-bar 4 previously inserted from the block molding step, this bar being firmly connected to the carbonaceous material without any interposition of cast iron, rammed or monolithic lining paste or the like, said current bus-bar being completely surrounded (embedded) by the carbonaceous material, except at one end which is designed for electrical connection.

Figure 5:
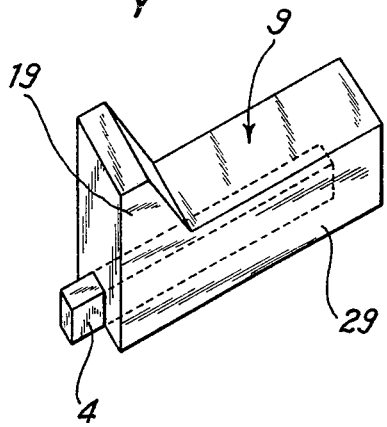
Figure 6:
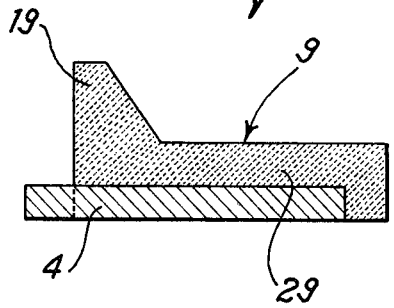
FIG. 6 is a longitudinal sectional view of the cathode shown in FIG. 5.

FIG. 5 and FIG. 6 are perspective and sectional views, respectively, showing as a further exemplary embodiment of a cathode according to the invention a cathode block 9 containing a current bus-bar 4 previously inserted from the molding step, and firmly connected to the carbonaceous material without any interposition of cast iron, rammed or monolithic lining paste or the like, this block being extended to comprise also an elevated rim 19 forming a portion of the side plate for the electrolytic cell. The two zones of the carbonaceous part, that is part 19 corresponding to the side plate, and part 29 corresponding to the actual cathode, may be formed of the same material, or different materials as cemented or casehardened during firing, and this for taking into account the different requirements demanded for the two parts in operation.

Figure 7:
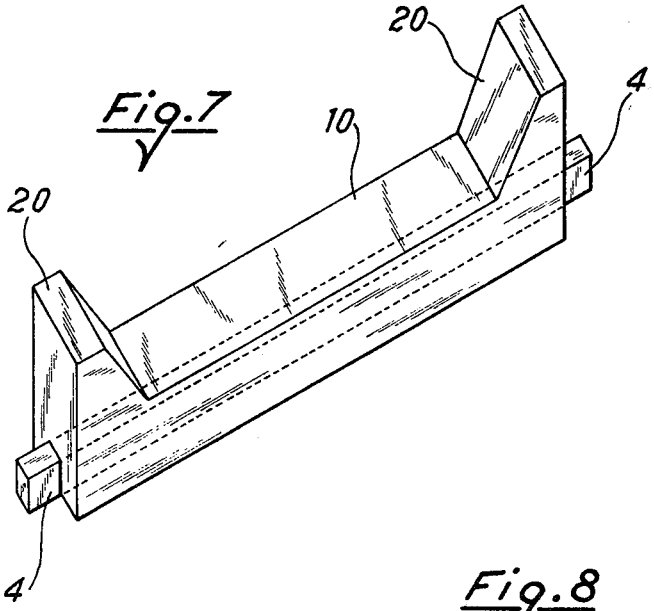
Figure 8:
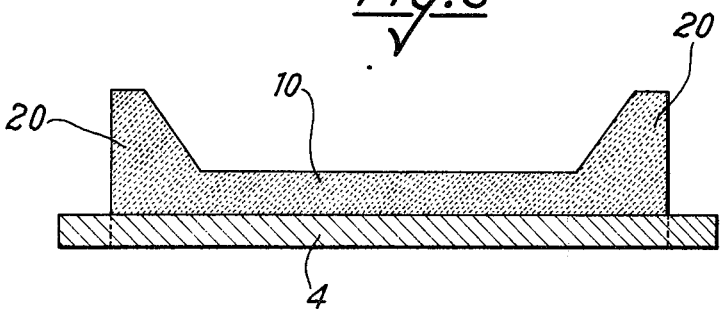
FIG. 8 is a longitudinal sectional view of the cathode shown in FIG. 7.

FIG. 7 and FIG. 8 are perspective and sectional views, respectively, showing as a further exemplary embodiment of a cathode according to the present invention, a cathode block 10, the length of this block being the same as the width of the cell, the block containing a single current bus-bar 4 previously inserted from the molding step, and firmly connected to the carbonious material without any interposition of cast iron, rammed or monolithic lining paste or the like, extending on both sides of the cell and comprising both side plates 20.

By implementing cathode blocks with a built-in bus-bar, that is previously inserted in said blocks from the molding step at the factory, the present invention avoids the usual bus-bar fastening or securing operation by means of cast iron casting, which as above stated is an expensive operation requiring particular care. Moreover, the electrical contact resistance between the metal bus-bar and carbonaceous material is reduced, since such a contact is more complete when carried out at the molding step. Additionally, the bus-bar cross-section shape can be conveniently varied, because of being no longer bound by problems of clamping by means of cast iron castings. When producing a block with an "embedded" bus-bar (FIG. 4), all of the section sides are useful for the purposes of electrical contact, and said bus-bar is also protected against bath attack.

Then, the extension of the cathode block to comprise also the side plate (FIGS. 5 to 8) will eliminate that transition zone which is the weakest and the most liable to shrinkages and separations, this zone comprising the rammed or monolithic lining paste of the prior art embodiments. Thus, the bath seepage to the bus-bars is hindered and the useful life for the cathode hearth or working area is extended.

What I claim is:

1. A cathode of a cell for producing aluminum by electrolysis of smelted salts thereof, prepared by providing a block of a carbonaceous material selected from the group consisting of carbon, graphite and semi-graphite, inserting a current bus-bar into said block and then molding and firing said block in direct contact with said bus-bar to form a cathode with said bus-bar at least partially embedded in said block.

2. The cathode as claimed in claim 1, wherein said cathode block has at at least one end thereof an elevated rim comprising a portion of side plate for the hearth or working area of an electrolytic cell.

3. The cathode as claimed in claim 2, wherein said elevated rim projects from two opposite sides of said block, the length of the latter being equal to the width of the electrolytic cell.

4. The cathode as claimed in claim 3, wherein said elevated rim and block are each made of a different of said carbonaceous materials cemented or casehardened to each other.

5. The cathode as claimed in claim 2, wherein said elevated rim and block are each made of a different of said carbonaceous materials cemented or casehardened to each other.

6. The cathode as claimed in claim 1, wherein said bus-bar is substantially completely surrounded by said carbonaceous material except at at least one end of the bus-bar.

7. A method of making a cathode of a cell for producing aluminum by electrolysis of smelted salts thereof, comprising the steps of providing a block of carbonaceous material selected from the group consisting of carbon, graphite and semi-graphite, inserting a current bus-bar in said block during molding thereof, and then firing said block with said current bus-bar to provide a rigid and resistant cathode.

* * * * *